United States Patent [19]

Galanty

[11] 4,186,888

[45] Feb. 5, 1980

[54] COMMINUTOR FOR SEWAGE FLOWING IN LIQUIDS

[76] Inventor: William B. Galanty, 1 Argyle Ct., Livingston, N.J. 07039

[21] Appl. No.: 927,492

[22] Filed: Sep. 18, 1978

[51] Int. Cl.[2] ..... B02C 23/30

[52] U.S. Cl. ..... 241/46.06

[58] Field of Search ..... 241/46 R, 46 A, 46.06, 241/46.11, 46.17, 46 B

[56] References Cited

U.S. PATENT DOCUMENTS

| | | | |
|---|---|---|---|
| 2,103,896 | 12/1937 | Doyle et al. | 241/46 R X |
| 2,305,935 | 12/1942 | Thom | 241/46 A X |
| 2,594,785 | 4/1952 | Meeker | 241/46 R X |
| 4,120,457 | 10/1978 | Link | 241/46 R |

*Primary Examiner*—Howard N. Goldberg

*Attorney, Agent, or Firm*—Hamlet E. Goore, Jr.; Clay Holland, Jr.

[57] ABSTRACT

An improved comminutor for channels or inline conduits that carry the flow of liquid sewage which includes a semi-cylindrical concave cage formed of a plurality of axially spaced apart sections of arcuate rings or bars connected together arcuately and axially. A plurality of comb-like members are mounted at spaced intervals along the inner surface contour of the semi-cylindrical concave cage member with the teeth of its comb-like members in axial alignment with corresponding sections of the rings or bars which form the cage member. A plurality of rotatable cutting and shredding arms are mounted axially along a helical spiral like path in spaced relationship with the cage member with a plurality of comb-like members for interengaging comminuting action with radially extending portions of their respective teeth. The teeth of the cutting and shredding arms may be in engagement with each tooth of the comb-like members and each of the slotted openings of the cage member at least once during each revolution of the cutting and shredding arms.

In another embodiment of the invention the comminutor includes a hemispherical concave cage formed in a similar manner as recited above with respect to the semi-cylindrical cage. In this embodiment the rotatable cutting and shredding arms extend radially outward and have a plurality of teeth at the periphery thereof which travel along paths that conform to the inner concave surface of the hemispherical cage so as to interengage in comminuting action with the cage and the comb-like cutter teeth in a similar manner as in the semi-cylindrical cage embodiment.

6 Claims, 4 Drawing Figures

COMMINUTOR FOR SEWAGE FLOWING IN LIQUIDS

BACKGROUND OF THE INVENTION

This invention relates to comminutors having signigicant solid material content carried by a flowing liquid, such as sewage for example, in a channel or pipe. Although the prior art comminutors have been of both the fixed or rotatable cage variety, the present invention is concerned primarily with the stationary or fixed cage variety and its improvements are directed to such comminutors. In the prior art these comminutors have had fixed cages generally formed of a plurality of axially spaced apart sections forming slots for the passage of the sewage, such devices may also include stationary cutting and shredding bars, commonly referred to cutter bars connected thereto, the bars have teeth formed thereon which may be in axial alignment with corresponding sections of the slots formed in the fixed cage. Such comminutor may have further means mounted in close spaced relationship with the fixed cage and cutter bars for interengaging comminutor actions.

Comminutors of foregoing types are well known and described in the prior art, for example such as in U.S. Pat. No. 2,305,935, to George L. Thom, issued Dec. 22, 1942. In this device the comminution of material contained in sewage is accomplished by a slotted straining member, either stationary or rotary, which intercepts pieces of materials which are too large to pass through the strainer slots and having cutting teeth which cooperate with one or more notched cutting bars to cut, shear or tear intercepted solids into pieces small enough to pass through the slots. In operation comminution of the solid materials occurs on the concave side of the strainer where a plurality of cutting teeth are disposed in the path of travel of the notches in the cutting bar, either one or more spaced about the axis of rotation of such bar or bars, whereby pieces are cut, sheared or torn form the solids that are caught between the cutting bar or bars and the cutting teeth.

U.S. Pat. No. 2,389,306, to Walter H. Green, issued Nov. 20, 1945 discloses in its preferred embodiment, a fixed semi-cylindrical grid forming a plurality of horizontal slots extending circumferentially to the grid having a plurality of rotatable circular discs having cutting teeth on the peripherie's of the discs by extending through the slots of the grid and a vertical cutter bar set into the wall of the conduit extending vertically along the periphery of the rotatable discs. In operation larger solids in the sewage are first caught or held by the upstream segments of the rotating plate which extend outwardly beyond the bars of the fixed grid, and will be nibbled by the rotating teeth or washed or carried over to the cutter bar. Thus such solids are caught between the cutting teeth and the cutting bar and small portions are punched through the cutter bar and into the down stream flow of sewage.

U.S. Pat. No. 2,594,785, to Herbert J. Meeker, issued Apr. 29, 1952, discloses a comminutor having a vertical stationary semi-cylindrical bar cage having a plurality of screening openings therein, further having one or more internal oscillating cutter arms together with means for oscillating the cutter arms backwards and forward over the concave surface of the cage. Each cutter arm carries shredding teeth which cooperate with shredding teeth removably carried by the bar cage to cut and shred collected screening openings in the semi-cylindrical bar cage. The cutter bar attached to the oscillating cutter arm or arms extends vertically across the inner concave surface of the semi-cylindrical cage at an acute angle such that the desired shearing action occurs advantageously.

SUMMARY OF THE INVENTION

In accordance with the present invention, an improved comminutor is constructed such that the rotatably mounted comminuting teeth of the device provide the functions of self sharpening, cutting and shredding action while at the same time they reduce the impact and shock between interengaging teeth of the stationary cutter teeth and the rotating cutting teeth. This construction also significantly reduces shock and vibration traditionally transmitted to the shaft of the motor to which the cutting arms are fixedly mounted. In addition, undesirable power consumption is substantially reduced owing to the more efficient operation of the device. More specifically, in a preferred embodiment of the present invention the comminutor includes a plurality of radially extending arms rotatably mounted in staggered spaced relationship about the axis of the device along a helical spiral-like path such that the cutting and shredding teeth which are connected at the periphery of the arms travel along circular paths wherein each set of teeth located at the periphery of the radially extending arms are substantially in a plane which is at an acute angle with respect to the axis of the device thereby providing unique structural and operational features of the present invention.

Among the objects of the present invention is the provision of a comminutor for solid materials in sewage liquid flow, which has means for continually and efficiently comminuting large pieces of sewage which are forced against an internal stationary semi-cylindrical concave cage of the comminutor by the flow of such sewage.

A further object of the invention is the provision of a device in which the various cutting or comminuting teeth can be easily replaced in case of wear or breakage.

Another object of the invention is the provision of a device in which the cutting or comminuting teeth are self sharpening.

Still another object of the invention is the provision of a device in which the occurrence of undesirable shock or stresses between the interengaging teeth of the device during rotation of the cutting and shredding arm and teeth is substantially reduced.

Still a further object of the invention is the provision of a device in which the power consumption is significantly reduced.

Yet another object of the invention is the provision of a device in which the teeth at the periphery of the rotatable arms extend into the slots of the cage so as to cut away and push solid material particles through the slots of the cage owing to them being unable to pass through the slots because of their size or due agglomerations of such particles in and about the slots.

Briefly the above stated and other objects of the invention are achieved by the provision of a comminutor including a stationary semi-cylindrical concave cage formed of a plurality of axially spaced-apart sections of rings connected together by circumferentially distributed axially extending members joining the rings and having a plurality of stationary cutter elements or bars axially disposed at preselected intervals along the concave surface of the cage having teeth formed thereon which extend radially inward toward the axis of the device and which are in axial alignment with corresponding inward extending solid portions of the slot elements of the cage. The comminuting action of the device is achieved by the rotatably mounted multiple arm cutting and shredding members of the device whose interengaging teeth mesh with cutter bars and slots of the concave cage member.

In addition to the comminuting action of the rotatable arms of the device, the teeth at the periphery of the rotatable arms penatrate into the slots of the cage and removes accummulated materials which may tend to block the passage of sewage flow through the slots of the cage.

Still another object of the invention is the provision of a device in which the axial height of the device is not limited by length of a single rotatable comminuting cutting arm of the device.

Still a further object of the invention is the provision of a device in which cross-sectional area of the slots of the cage is significantly increased to thereby reduce head loss during the flow of fluids through the cage.

BRIEF DESCRIPTION OF THE DRAWINGS

The realization of the above features and advantages along with others of the present invention will be apparent from the following description and the accompanying drawings in which.

DESCRIPTION OF REPRESENTATIVE EMBODIMENTS OF THE INVENTION

Figure 1:
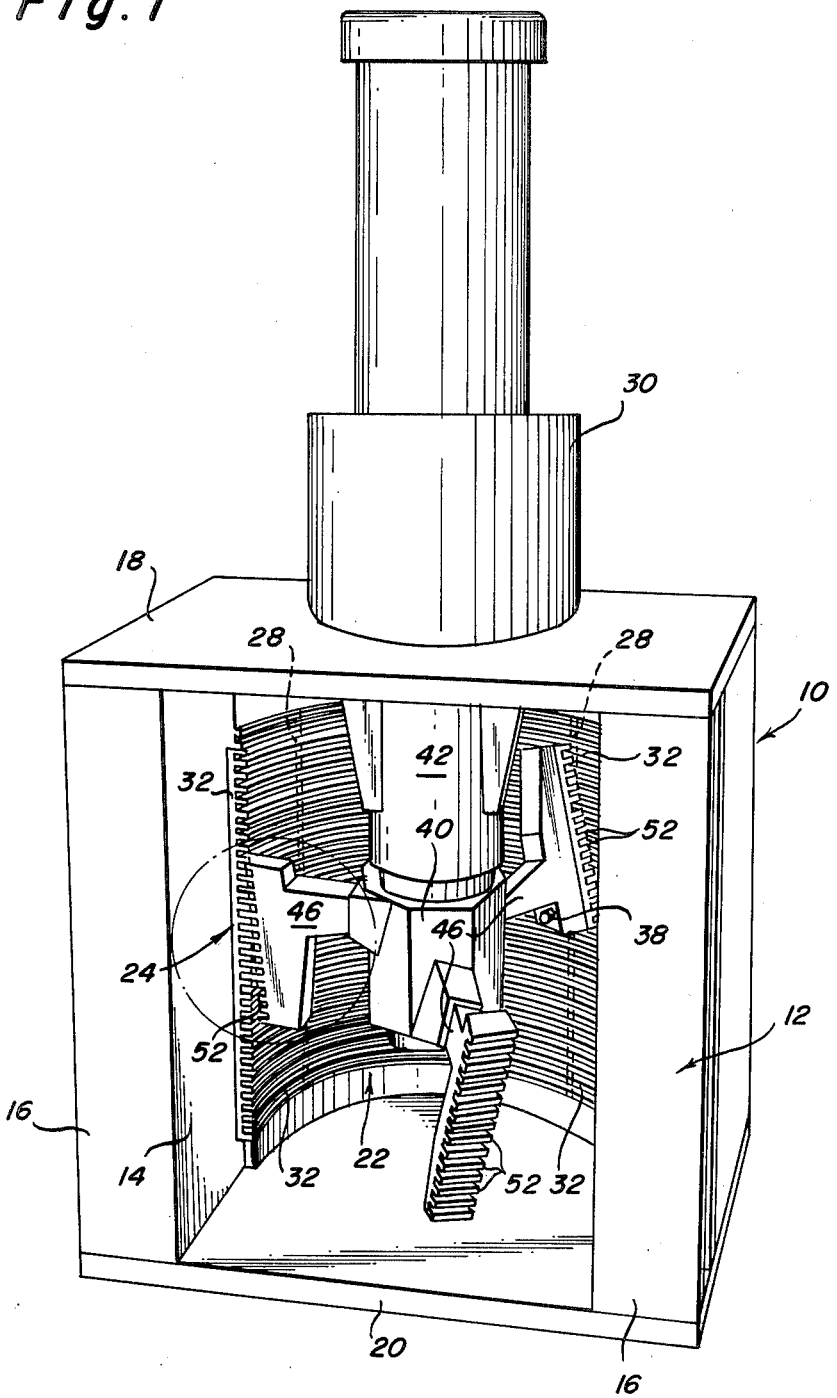
FIG. 1 is a detail perspective view of a comminuting device embodying the present invention.

Referring now to the drawings, there is shown in FIG. 1 the improved comminutor 10 which includes a support frame 12 having parallel sides 14 connected respectively to flanges 16. The support frame 12 supports a removable top cover plate 18 and sits on a bottom plate 20 fixedly connected thereto which supports the entire device. The support frame 12 also supports a semi-cylindrical concave cage 22 and at the rear or down stream portion of the device a plurality of cutter bars 24 which extend axially along the frame 12. The semi-cylindrical cage 22 is formed of a plurality of axially spaced apart sections of arcuate rings or bars 26 connected together arcuately and axially. These rings sections 26 are partially supported by a plurality of axially disposed support members 28 which are affixed to the ring sections 26 along the outer circumferential surfaced thereof. The axially spaced apart rings form a plurality of slotted openings cutting the cage 22 in planes perpendicular to an axis of the device and a motor 30 which is mounted on top of the removable cover 18 so that is shaft protrudes there through.

The slotted openings 32 formed by the ring sections 26 have an arcuate configuration conforming to and forming the concave surface of the cage 22.

Figure 2:
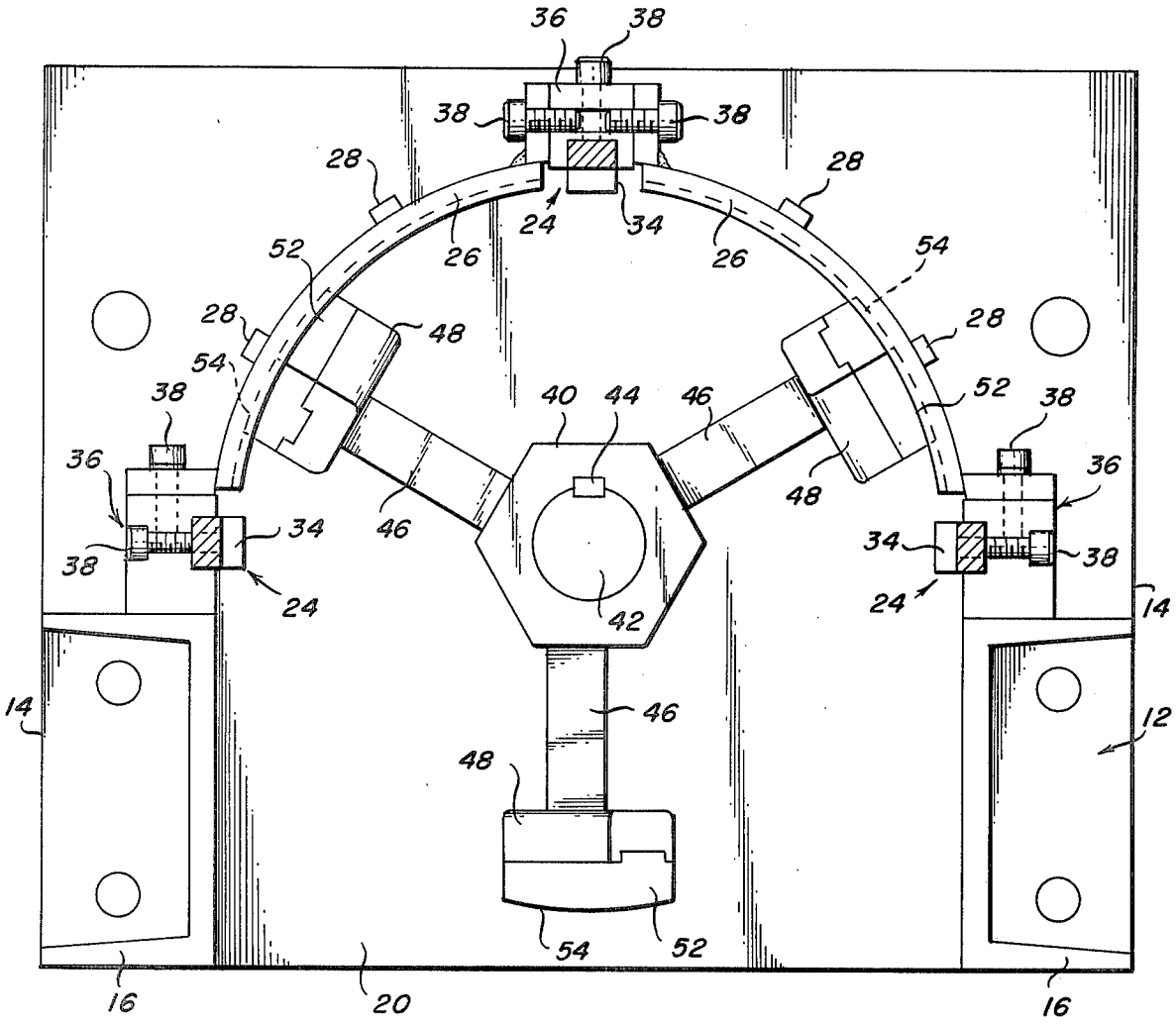
FIG. 2 is a top section view of the comminutor illustrating the relative positions of the various components of the comminutor for interengaging action.

Referring to FIG. 2 the cutter bars 24 may be seen at three equally spaced locations along the concave surface of cage 22. As shown in FIG. 1 a plurality of cutter teeth 34 are formed in the cutter bar 24 so as to give it a comb-like appearance. In FIG. 2 the cutter bars 24 are each supported by a support members 36 secured thereto by several screws 38. The cutter bars 24 may be readily removed for purposes of replacement by the removal of the various screws 38 holding each of the bars.

As shown in FIGS. 1 and 2 the ring sections 26 and cutter bar teeth 34 are disposed in an alignment along the inner concave surface of cage 22. It should be noted the cutter bar teeth 32 protrude radially inward toward the axis of the device a distance slightly greater than the slot elements or ring sections 26 of the cage 22. This slight protrusion of cutter teeth 34 provide an advantageous aspect of the invention and will be discussed hereinafter in connection with operation of the device . As shown in FIG. 1 the cutter teeth 34 and the ring sections 26 are in axial alignment with each other so as to cooperate in the comminuting action of the device.

The device 10 further includes a hub 40 which is fitted on to a shaft 42 of motor 30. The shaft of the motor projects downward from motor 30 through removable cover 18 having its center along the axis of the device and is radially equally spaced from the concave surface of the cage 22. As shown in FIG. 2 the hub 40 is secured to shaft 42 by key 44.

As shown in FIGS. 1 and 2 hub 40 has a plurality of arms or webs 46 extending radially therefrom. Connected to the end of each web is fixedly connected an arm section 48 which in turn supports a cutting and shredding comb-like bar 50 having a plurality of teeth 52 formed thereon. As shown in FIG. 2 the teeth 52 of comb-like bar 50 extends radially outward from the axis into the slots 32 of the cage 22 about one half of the width of the rings 26. In contrast the teeth 52 extend substantially the entire radial length of cutter bar teeth 34 in a intermeshing fashion.

Figure 3:
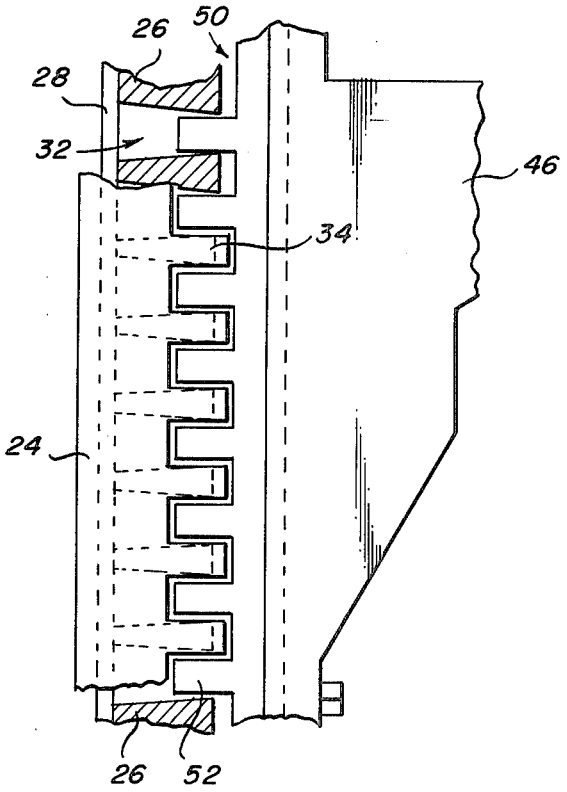
FIG. 3 is a fragmentary enlarged view partly in section of the cutter bar, semi-cylindrical cage slots and cutting and shredding teeth connected the periphery of the rotatable cutting arm shown in the encircled are of FIG. 1.
Figure 4:
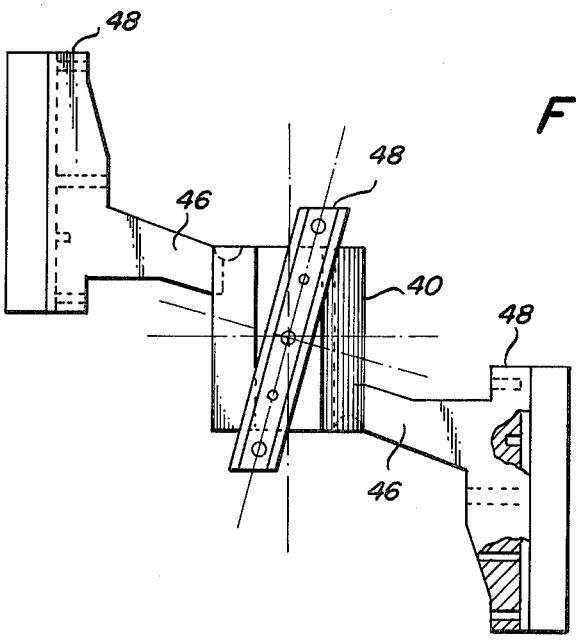
FIG. 4 is a view of cutting arms and teeth of the comminutor illustrating the arcuate angle of one of the cutting and shredding teeth members makes with the axis of the device.

Referring to FIG. 3 there is shown an enlarged view of the area encircled in FIG. 1 detailing the relationship of the teeth 34 of cutter bar 24, the teeth 52 of the comb-like bar 50 and the slots 32 formed by ring sections 26 of cage 22. The arm section 48 is depicted in FIG. 3 as being vertically disposed. However, in present invention arm 48 is disposed at an angle with respect to the axis of the device. Referring to FIG. 4 the arm section 48 is shown slanted at an acute angle with respect to the axis of the device. In accordance with the present invention an acute angle of 15 degrees has been found to provide efficient and substantially shock and vibration free operation.

It should be noted that the arm or web 46 as shown in FIG. 4 is centered on the hub 40 such that the center of the axial length of arm section 48 is in alignment with center of hub surface to which it is connected. In addition, it should be noted that the center line of the arm section has a preselected angular relationship with the center of the hub.

To continue with the description of the rotatable mounted arms, specific attention is directed to the fact that there are three arms 46 fixedly connected to hub 40 at equally spaced circumferial degrees apart about the shaft. In addition to being spaced equal distance apart about the axis, the arms are uniquely staggered about the axis along an imaginary axial helical spiral path surrounding the axis and extending the full length of the comminuting surface of the cage 22.

It should be noted with reference to FIGS. 1 and 2 that the comb-like bars 50 of the device are substantially linear along the axial length. The significance of this configuration resides in the fact that such construction is advantageous in the manufacture and construction of the present invention. More specifically, in order to use a screen or cage member of significant axial length in the absence of the staggered arms 48 as disclosed by the present invention it would be necessary to utilize a rotable comb-like bar whose axial length would be equal to or greater than the axial height of the screen or cage utilized. In order to utilize such an axially long member it would be necessary to provide such comb-like cutting bar with a twisted configuration along its axial dimension. The twist in the axial dimension of the cutting bar would be necessary to enable the cutting arm to successfully rotate through the slots of the screen or cage. It has been found that it is extremely difficult and in many instances impossible to practically and economically produce cutting comb-like bars with reproducible accuracy such that the comminuting en-terengaging action between the cutter bars, cage slots and the cutting bar teeth mesh smoothly during rotation of the cutting arm.

However, the foregoing difficulty has readily been overcome by the present invention through the use of the staggered arm arrangement disclosed herein. Thus, without known exception the use of an unlimited number of staggered arms may be utilized to accommodate substantial any axial length of screen or cage de sired.

As noted hereinabove, the web 46 of the rotatable cutting arms are connected to the hub 40 at preselected points. It should be noted that the connection of the rotatable arms to the hub as disclosed herein, as illustrated at 120° intervals, has provided means for enhanced operation where long axial cages are desired. This has not been readily accomplished with heretofore known structural arrangements.

Another significant improvement in the present invention arises from the fact that the ring members 26, have a substantially smaller dimension along the axis a much wider dimension in the planes perpendicular to the axis. This thin wafer-like configuration for ring members 26 provide the structural strength needed in the screen or cage of the device while substantially reducing the cross-section areas thereof to thereby substantially reduce the obstructional aspects of wider configurations utilized in prior art devices. There is no loss of structural strength in this configuration since the rings are supported by affixedly connected support members 28.

It has been found through experience in service that substantially smooth operation occurs when the combination of the staggered disposition of the arms and its connected teeth and the slanted disposition the same teeth with respect to the axis when combined with the cutting and shredding teeth 52 on each arm which mesh with less than one half of the teeth 32 of the cutter bar 24. More specifically, in one design configuration employed in accordance with the present invention the semi-cylindrical concave cage 22 was constructed with approximately thirty-four slots 32. The cutter bars 24 had a corresponding number of teeth 34 and the comb-like bars 50 were each provided with about fifteen teeth 52. In operation, the number of teeth meshing or in interengagement between teeth 34 and 52 during each revolution of the hub 40 was about eight teeth of each arm at any instance during the passage of the teeth 52 through the teeth 34. Owing to the very small clearance which exist between teeth 34 and 52 and slanted disposition of bar 50 there occurs a shearing action between each tooth of cutter bar 24 and comb-like bar 50. Thus, efficient shearing action has been experienced according to the present invention owing to the fact that only a portion of teeth 52 are in interengaging contact with the teeth of the individual cutter bar 24 at any time during each revolution of the hub.

In addition to foregoing advantages it has been observed by laboratory measurements that the magnitude of impact shock experienced by the cutter bar 24 is substantially reduced, to the extent that it is considered negligible. As a result of such shock reduction the number of revolutions possible per each comminutor has greatly increased because of the reduced breakage or wear experienced between the teeth.

Another operational advantage of the comminutor of the present invention arises from the fact that there is substantial shock reduction between the meshing teeth which in turn reduced vibrations which would be transmitted to the shaft of the motor if the impact shock had not been substantially reduced. As it is known and can be appreciated by those experienced in the comminutor art, the presence of undesirable vibrations tend to reduce the life of drive motors 30 causing such problems of burning the motor, and on occasions causing the rotating member such as hub 40 to shake loose and come off the shaft 20 after a relatively short time.

Still another operational advantage of the present invention resides in the fact that the substantial elimination of shock and vibration within the device during rotational operation reduces the degree of misalignment in the motor shaft experience during the life of the device.

Yet another operational and functional advantage of the present invention resides in the fact that the comminuting teeth 52 penetrate slots 32 to an advantageous depth to thereby provide a unique means for sweeping solid materials off the surface of cage and while sweeping some solids through the slots while also comminuting other larger particles between the teeth 34 of the cutting bars 24 and teeth 52. Thus, the combined action of the fluid flow within the systems and the sweeping action of the comminuting teeth 52 readily enable the slots of the cage to be relatively free of blockage for continuous flow of sewage or other media.

Still a further advantage of the present invention arises from the fact that cross-sectional areas of rings 26 in planes perpendicular to the axis of the device are significantly less than used in the prior art devices. The smaller cross-sectional surfaces of said rings reduces the head losses during flow of the fluids through the screen or cage of the device and thereby provide a device of more efficient fluid flow.

Finally, the simplicity of construction of th present invention offers another advantage for economy of manufacture, operation and maintenance for commercial use.

It will be understood by those skilled in the art that the above-described embodiment is intended to be merely exemplary, in that it is susceptible to modification and variation without departing from the spirit and scope of the invention. For example, it will be apparent that the comminutor in accordance with the present invention may be adapted for inline system operation whereby the semi-cylindrical concave cage 22 is replaced by a semi-spherical cage and the rotatable cutting and shredding comb-like bars 50 is replaced by comb-like bar having configuration at the ends of arm sections 48 which form a portion of arc having a C-shape conforming the inner concave shape of the semi-spherical cage formed. The cutter bars 24 may be replaced by C-shaped members whose teeth are in alignment with the ring sections forming the semi-spherical cage. Operation of such a modified structure would be substantially similar to the device described hereinabove.

Another example of a modification of the invention is that of setting the cutter bars 24 on the convex side of the cage 22. In the modification the teeth 52 would be extended to the full depth of slots 32 such that the entire slotted areas would be cleared out on each rotation of the comminutor arms. The cutting and shredding action would occur predominately near the exit side of the cage. All such structural modifications and variations, therefore, are intended to be included within the scope and spirit of the invention, as defined by the appended claims.

What is claimed is:

1. An improved comminutor for a sewage channel comprising a semi-cylindrical cage member forming a concave surface traversely disposed in said sewage channel along a flow path of said channel, said cage having a plurality of slotted openings cutting said cage member in planes perpendicular to an axis thereof and said slotted openings forming a plurality of spaced apart arcuate bar-like elements extending along the full concave length of said cage and extending along the axial dimension of the concave surface of said cage; a plurality of removably fixed comb-tooth cutting and shredding members having a plurality of spaced apart teeth formed along an inner surface thereof, said cutting and shredding members being disposed parallel to the axis of said cage having said inner surface teeth extending radially toward said axis in alignment along the axis of said cage with a corresponding plurality of spaced apart bar-like surfaces of said cage and said cutting and shredding teeth extend radially toward the axis of said cage a distance greater than that of said bar-like surfaces of said cage; and a plurality of cutting and shredding arms mounted for rotation about the axis of said cage member and located on the upstream side of said concave surface of said cage and having a plurality of teeth on each of said arms for interengaging said teeth of said fixed comb-tooth member and extending into said slotted opening of the bar-like surface of said cage and driving means for rotating said plurality of cutting and shredding arms along the inner concave surface and slots of said cage and comb-tooth member for inter meshing with said slots of the cage over the the full concave peripherical length of said slots of said cage.

2. The comminutor defined in claim 1 wherein said cutting and shredding rotatable arms are further defined as being fixedly mounted in a staggered relationship along the axis of the comminutor in a uniform helical spiral path.

3. The comminutor defined in claim 2 wherein said teeth on the cutting and shredding arms are positioned at an acute angle with respect to said axis of the comminutor for interengaging a portion of the teeth of said cutter bar during each revolution of said driving means.

4. An improved comminutor for a sewage system comprising, (a) a semi-cylindrical cage adapted to be interposed across a flowing stream of sewage containing solid material;

(b) a plurality of horizontal slots extending circumferentially of said cage along the full concave peripherical coextensive length thereof;

(c) a plurality of stationery cutter bars disposed axially along the inner concave surface of said cage having a plurality of teeth formed along one edge thereof extending inward toward the axis of the device and forming slots between said teeth of said cutter bars, each of said slots of said cutter bars being disposed to match a corresponding slot of said cage;

(d) a plurality of rotatable arms extending radially from the axis of the comminutor having a plurality of teeth extending axially there along (adjacent to concave surface of said cage and said cutter bars) and extending radially into the slots of said cage and said cutter bars and intermeshing with said slots along the full concave peripherical length of said cage; and (e) driving means for rotating said arms in interengaging action with said teeth of said cutter (bar) bars and said slots of said cage.

5. The comminutor defined in claim 4 wherein said rotatable arms are further defined as being fixedly mounted to said driving means in a stagged spaced relationship along the axis of the comminutor in a helical spiral path and said teeth on said rotatable arms are further deposed at an acute angle with respect to said axis along the axial surface of said cage.

6. The comminutor defined in claim 5 wherein the slots of said semi-cylindrical cage are further defined as being formed of ring like sections having a dimension in planes perpendicular to the axis of the comminutor which is substantially greater than the dimension thereof along the axis of the comminutor.

* * * * *